US008505904B2

(12) United States Patent
Min et al.

(10) Patent No.: US 8,505,904 B2
(45) Date of Patent: Aug. 13, 2013

(54) BOOKBINDING DEVICE AND PRINT-MEDIUM POST-TREATMENT APPARATUS HAVING THE SAME

(75) Inventors: Ji Hoon Min, Yongin-si (KR); Chang Soo Byun, Hwaseong-si (KR)

(73) Assignee: SAMSUNG Electronics Co., Ltd., Suwon-si (KR)

( * ) Notice: Subject to any disclaimer, the term of this patent is extended or adjusted under 35 U.S.C. 154(b) by 0 days.

(21) Appl. No.: 12/862,996

(22) Filed: Aug. 25, 2010

(65) Prior Publication Data

US 2011/0052294 A1 Mar. 3, 2011

(30) Foreign Application Priority Data

Sep. 2, 2009 (KR) ..... 10-2009-0082608

(51) Int. Cl.
*B65H 39/00* (2006.01)

(52) U.S. Cl.
USPC ..... 270/58.11; 270/58.07

(58) Field of Classification Search
USPC ..... 270/37, 58.01, 58.07, 58.08, 58.11, 270/58.12, 58.17; 399/408, 410
See application file for complete search history.

(56) References Cited

U.S. PATENT DOCUMENTS

| | | | | |
|---|---|---|---|---|
| 5,911,414 | A * | 6/1999 | Kato et al. | 270/58.07 |
| 5,992,839 | A * | 11/1999 | Kosasa | 270/58.12 |
| 6,712,349 | B2 * | 3/2004 | Watanabe | 270/37 |
| 6,921,069 | B2 * | 7/2005 | Suzuki et al. | 271/207 |
| 7,043,192 | B2 * | 5/2006 | Terao et al. | 399/407 |
| 7,520,505 | B2 * | 4/2009 | Thomas et al. | 271/220 |
| 7,862,015 | B2 * | 1/2011 | Kotani | 270/32 |
| 7,922,165 | B2 * | 4/2011 | Kamiya | 270/58.17 |
| 2006/0017210 | A1 * | 1/2006 | Sato et al. | 270/58.08 |
| 2008/0099973 | A1 * | 5/2008 | Kotani | 270/32 |
| 2008/0308986 | A1 * | 12/2008 | Dobashi et al. | 270/12 |

* cited by examiner

*Primary Examiner* — Leslie A Nicholson, III
(74) *Attorney, Agent, or Firm* — Stanzione & Kim LLP

(57) ABSTRACT

A bookbinding device and a print-medium post-treatment apparatus having the same. In the bookbinding device, when a print medium drops and is loaded a stack plate, a drop position of a leading end of the print medium is changed according to a size of the print medium. This prevents sequence upset of print media when the print media are stacked one above another on the stack plate.

16 Claims, 16 Drawing Sheets

BOOKBINDING DEVICE AND PRINT-MEDIUM POST-TREATMENT APPARATUS HAVING THE SAME

CROSS-REFERENCE TO RELATED APPLICATIONS

This application claims priority under 35 U.S.C. §119 from Korean Patent Application No. 2009-0082608, filed on Sep. 2, 2009 in the Korean Intellectual Property Office, the disclosure of which is incorporated herein in its entirety by reference.

BACKGROUND

1. Field of the Invention

Embodiments of the present general inventive concept relate to a bookbinding device to bind a plurality of print media transmitted from an image forming apparatus and a print-medium post-treatment apparatus having the same.

2. Description of the Related Art

In general, a print-medium post-treatment apparatus is arranged parallel to an image forming apparatus. In one example, a print-medium post-treatment apparatus contains a punch or stapler to perform a punching or stapling operation on a print medium, on which an image has been completely formed, transmitted from an image forming apparatus.

Some recent print-medium post-treatment apparatuses include a bookbinding device in which a plurality of print media transmitted from an image forming apparatus is centrally folded into two and is bound to form a book, such as a booklet.

The bookbinding device may be required to include a stapler to staple the center of the print media, a pair of press rollers arranged to face each other, and a folding knife installed to be forwardly or backwardly movable so as to fold and push the printed media into a gap between the two press rollers. In operation, after the stapler staples the center of the print media, the folding knife moves into the gap between the press rollers, folding the print media into two on the basis of the stapled center of the print media, whereby bookbinding of the print media is completed.

SUMMARY

The present general inventive concept provides a bookbinding device to prevent sequence upset of print media when the print media are stacked one above another for bookbinding, and a print-medium post-treatment apparatus having the same.

Additional aspects and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a bookbinding device including a guide plate installed to obliquely extend and having a lower surface to guide a print medium to drop down, a stack plate installed below the guide plate to obliquely extend in a direction corresponding to the guide plate and having an upper surface on which the print medium is loaded, and a guide member to change a drop position of a leading end of the dropping print medium according to a size of the print medium.

The guide member may be downwardly spaced apart from the guide plate to face each other and may be movable in a direction parallel to the guide plate.

The bookbinding device may further include supporting plates to movably support both ends of the guide member, and the supporting plates respectively may have guide slots into which the guide member is movably fitted.

The bookbinding device may further include a guide motor that is rotatable forward or reverse, a pair of guide pulleys arranged at either side of the guide member in a moving direction of the guide member, and a guide belt, both sides of which are wound on the pair of guide pulleys, and the guide member may be connected to the guide belt.

The bookbinding device may further include a paddle rotatably installed to the supporting plates, the paddle being rotated upon receiving rotational force to move the leading end of the dropping print medium to the stack plate.

The bookbinding device may further include a lifting device installed to the stack plate to move the print medium loaded on the stack plate up and down.

The lifting device may include a lifting member to support a lower end of the print medium loaded on the stack plate, the lifting member being obliquely moved up and down by an inclination corresponding to the stack plate.

The lifting device may include a lifting motor to generate rotational force, a pair of lifting pulleys arranged at opposite sides of the lifting member in a moving direction thereof so as to be rotated upon receiving the rotational force from the lifting motor, and a lifting belt both sides of which are supported on the pair of lifting pulleys, and the lifting member may be connected to the lifting belt.

The bookbinding device may further include a pair of press rollers arranged to face an upper surface of the stack plate, and a folding knife forwardly or rearwardly movably installed to the stack plate, so as to protrude from the stack plate and enter a gap between the press rollers.

The foregoing and/or other features and utilities of the present general inventive concept may also be achieved by providing a bookbinding device including a guide plate installed to obliquely extend and having a lower surface to guide a print medium to drop down, a stack plate installed below the guide plate to obliquely extend in a direction corresponding to the guide plate and having an upper surface on which the print medium is loaded, and a guide member downwardly spaced apart from the guide plate to face each other, the guide member being moved to be located above a partial upper end region of the print medium loaded on the stack plate.

The foregoing and/or other features and utilities of the present general inventive concept may also be achieved by providing a print-medium post-treatment apparatus including a bookbinding device to bind a print medium, on which an image has been completely formed, transmitted from an image forming apparatus, the bookbinding device includes a guide plate installed to obliquely extend and having a lower surface to guide a print medium to drop down, a stack plate installed below the guide plate to obliquely extend in a direction corresponding to the guide plate and having an upper surface on which the print medium is loaded, and a guide member to change a drop position of a leading end of the dropping print medium according to a size of the print medium.

The foregoing and/or other features and utilities of the present general inventive concept may also be achieved by providing a bookbinding device usable with an image forming apparatus, including a stack plate disposed to receive a print medium along a stacking direction, and a guide member disposed to move along the stacking direction to control a leading end of the print medium with respect to the stack plate.

The guide member may move in a direction corresponding to one of the stacking direction and a reverse direction of the stacking direction according to a size of the print medium.

The guide member may move between a first position and a second position which are disposed on the stacking direction to control a dropping position of the leading end of the print medium with respect to the stack plate.

The bookbinding device may further include a guide plate disposed to receive the print medium and to guide the received print medium toward the stack plate in the stacking direction.

The guide plate may have a surface to contact the print medium to guide the print medium, and the guided print medium has the leading end to free-fall toward the stack plate from the guide plate.

The guide member may contact the free-falling leading end of the print medium to change a dropping direction of the leading end of the print medium with respect to the stack plate.

The guide member may control a free-falling position of the free-falling leading end of the print medium to be stacked on the stack plate.

The print medium may include a first print medium and a second print medium, and the guide member may move with respect to at least one of the guide plate and the stack plate in a direction corresponding to the stacking direction to control the free-falling end of the print medium such that the second print medium is prevented from being inserted between the stack plate and the first print medium which has been stacked on the stack plate.

The guide member may be movable with respect to the stack plate before the first print medium and the second print medium are guided and stacked, and the guide member may be stationary during stacking the first print medium and the second print medium.

The guide member may be movable with respect to the stack plate when the first print medium and the second print medium are guided and stacked on the stack plate.

The guide member may be disposed between the guide plate and the stack plate, and the guide member may move in a direction to change the stacking direction of the leading end of the print medium with respect to the stack plate.

The bookbinding device may further include a frame to accommodate the stack plate and the guide member, and the frame may include a guide slot formed thereon to guide the guide member to be movable in a direction to correspond to the stacking direction.

The guide slot may be formed in a linear-guide slot to linearly guide the guide member.

The guide slot may be formed in a non-linear-guide slot to non-linearly guide the guide member The guide member may move in a direction having an angle with a major surface direction of the stack plate on which the print medium is fell and stacked.

The bookbinding device may further include a bookbinding stapler disposed to staple the print medium stacked on the stack plate, and the guide member may move with respect to the bookbinding stapler.

The stack plate may move with respect to the bookbinding stapler to adjust a position of the stack print medium according to a stapling position of the stacked print medium.

The bookbinding device may further include a folding element disposed to be movable to fold the stapled print medium, and the guide member may be movable with respect to the folding element when the folding element is stationary.

BRIEF DESCRIPTION OF THE DRAWINGS

These and/or other aspects of the present general inventive concept will become apparent and more readily appreciated from the following description of the embodiments, taken in conjunction with the accompanying drawings of which.

DETAILED DESCRIPTION OF THE EMBODIMENTS

Figure 1:
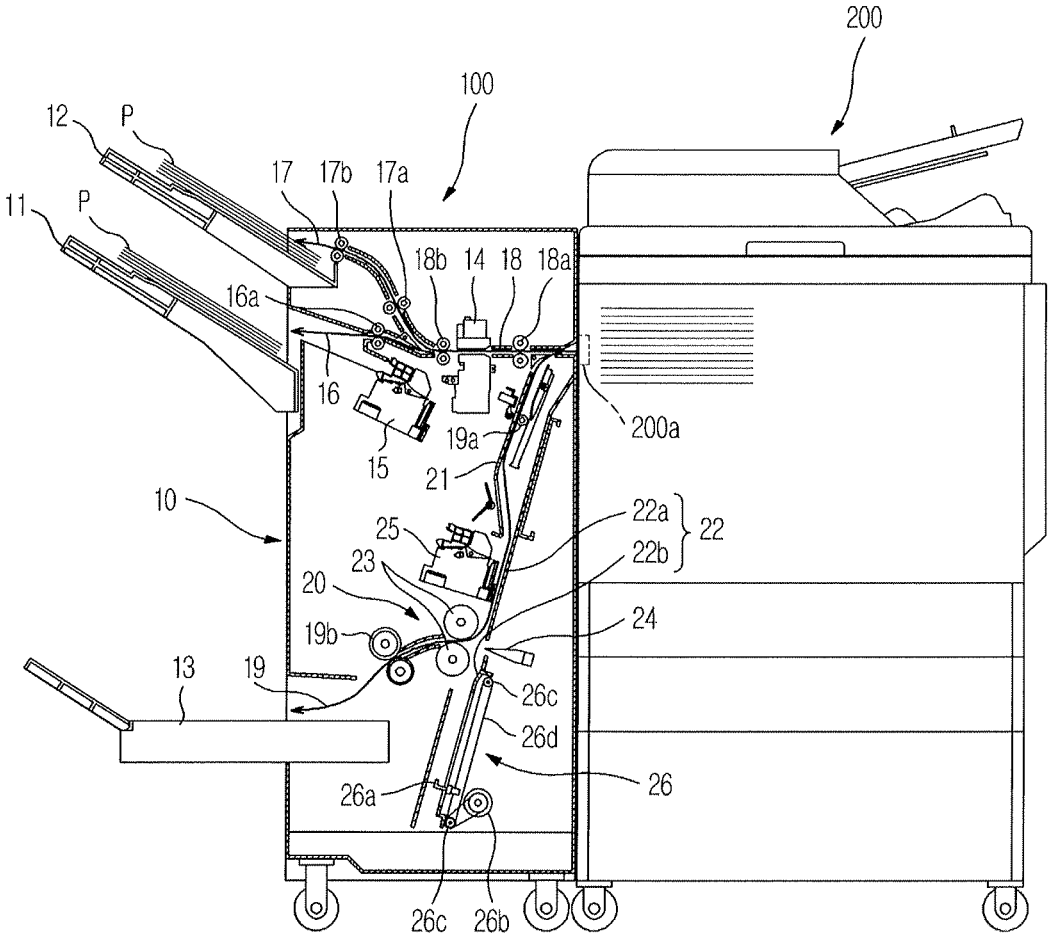
FIG. 1 is a sectional view illustrating a schematic configuration of a print-medium post-treatment apparatus according to an exemplary embodiment of the present invention.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, a print-medium post-treatment apparatus 100 according to the exemplary embodiment is coupled to a side of an image forming apparatus 200. The print-medium post-treatment apparatus 100 may be designed to perform, e.g., a bookbinding operation, a punching operation, and a stapling operation on a plurality of print media P, on each of which an image has been completely formed, transmitted from the image forming apparatus 200. The bookbinding operation is an operation to fold the print media P into two on the basis of the center thereof and bind the folded print media P to form a book. The punching operation is an operation to punch holes required to bind the print media P, and the stapling operation is an operation to bind the plurality of print media P together.

The print-medium post-treatment apparatus 100 includes a body 10 defining an outer appearance of the apparatus 100, one side of which is connected to the image forming apparatus 200, and a plurality of stack trays 11, 12 and 13 provided at the other side of the body 10 so that print media P, which have been subjected to post-treatment, are loaded on the stack trays 11, 12 and 13. In addition, to perform the above mentioned operations, e.g., a bookbinding device 20, a punch 14, and a stapler 15 are accommodated in the body 10.

The image forming apparatus 200 may have a discharging port 200*a* to discharge a printing medium, for example, a sheet of paper with a corresponding image formed thereon in a discharging direction. The print-medium post-treatment apparatus 100 may have a unit to receive the printing medium discharged from the image forming apparatus 200 through the discharge port 200*a* and to distribute the received printing medium into a corresponding one of paths of the print-medium post-treatment apparatus 100 for post treatment, such as, the bookbinding operation, the punching operation, and the stapling operation. The unit may be controlled by a control signal selected by a user or generated from at least one of the post-treatment apparatus 100 and the image forming apparatus 200. The control signal can also be used to control a corresponding unit for the bookbinding operation, the punching operation, and the stapling operation, for example.

The plurality of stack trays 11, 12 and 13 includes a first stack tray 11 to load a first print medium, for example, standard sized paper thereon, a second stack tray 12 arranged above the first stack tray 11 to load a second print medium, for example, irregular sized print media P of a predetermined size or more or relatively thick print media P such as envelopes thereon, and a bookbinding stack tray 13 arranged below the first stack tray 11 to load a stack of print media P bound by the bookbinding device 20.

A plurality of delivery paths is defined in the body 10. The delivery paths include a first delivery path 16 for paper guidance to the first stack tray 11 in a first direction, a second delivery path 17 for paper guidance to the second stack tray 12 in a second direction, a main delivery path 18 to guide the print media P transmitted from the image forming apparatus 200 to a junction of the first delivery path 16 and the second delivery path 17 in a main direction, and a bookbinding delivery path 19 used not only to guide the print media P transmitted from the image forming apparatus 200 to the bookbinding device 20, but also to guide the resulting bound print media P to the bookbinding stack tray 13 in a third direction.

The punch 14 is located on a position of the main delivery path 18 to punch the print media P moving along the main delivery path 18. The stapler 15 is located on a position of the first delivery path 16 to staple the print media P moving along the first delivery path 16. In addition, a plurality of delivery rollers 17*a*,18*a*,and 19*a* and a plurality of discharge rollers 16*a*, 17*b*,18*b* and 19*b* are installed on the corresponding delivery paths 16, 17, 18 and 19, to guide the print media P to the stack stays or discharge the print media P from the stack strays.

The above-described rollers may have a pair of rollers disposed opposite to each other with respect to the corresponding paths. In this case, one of the pair of rollers may rotate according to a rotation source or a driving unit of the print-medium post-treatment apparatus 100, and the other one of the pair of rollers may rotate according to a friction with the print media and/or a rotation force of the one of the pair of rollers, such that the print media P can be fed or transmitted through the corresponding path. It is possible that one of the pair of rollers can be movable with respect to the other one of the pair of rollers to provide a space therebetween so that the print media P can be transmitted and fed according to a thickness of the print media P which are stacked or are simultaneously transmitted therebetween. Since the movement of the roller with respect to the path or the other roller is well known, detailed descriptions thereof will be omitted.

Figure 2:
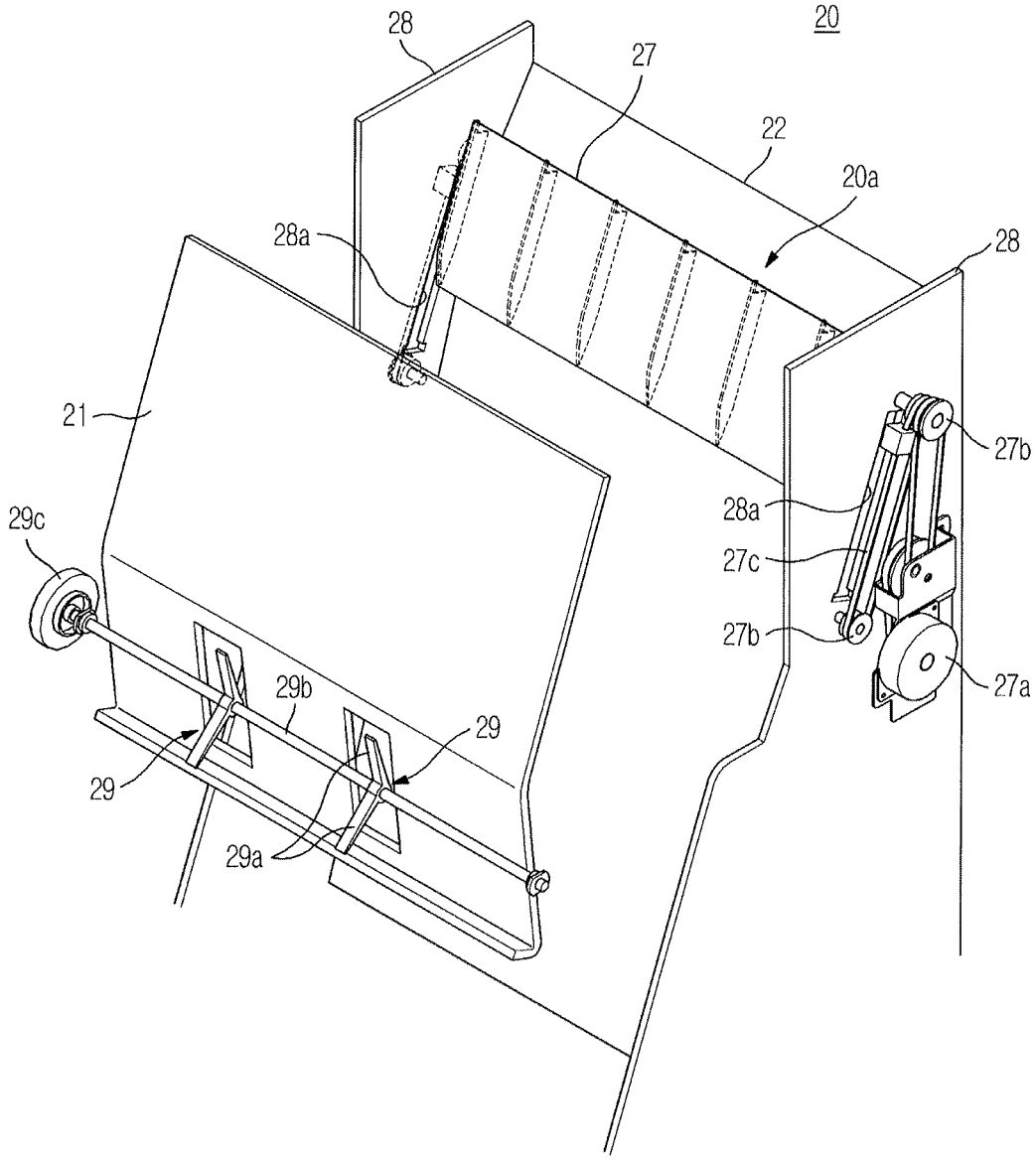
FIG. 2 is an exploded perspective view illustrating installation of a guide member provided in the print-medium post-treatment apparatus according to the exemplary embodiment.

The bookbinding device 20, as illustrated in FIGS. 1 and 2, includes a guide plate 21, a stack plate 22, a pair of press rollers 23, a folding knife 24, and a bookbinding stapler 25. The guide plate 21 and the stack plate 22 may be referred to as a stacking unit 20*a* to receive the print media P from the discharge port 200*a* of the image forming apparatus 200 and to stack the received print media P in order such that the stacked print media P are arranged to be stapled, folded and fed by the bookbinding stapler 25, the folding knife 24, and the pressing rollers 23. The stack unit 20*a* may include a frame to accommodate elements or units of the bookbinding device 20. The guide plate 21 obliquely extends from the discharging port 200*a* with respect to a discharging direction so that the print media P transmitted from the image forming apparatus 200 drops under guidance of a lower surface of the guide plate 21. The stack plate 22 is located below the guide plate 21 to obliquely extend by an inclination corresponding to that of the guide plate 21, so that the print media P, which are dropped from the guide plate 21, are loaded on an upper surface of the stack plate 22. The pair of press rollers 23 is arranged to face each other so that one of the press rollers 23 is located on the upper surface of the stack plate 22 and the other one is located in front of the stack plate 22. The folding knife 24 is installed to the stack plate 22 so as to be forwardly or backwardly movable with respect to the stack plate 22, the print media P, and/or the press rollers 23. As the folding knife 24 protrudes from the stack plate 22 to enter a space between the pair of press rollers 23, the print media P loaded on the stack plate 22 are folded into two with respect to the center thereof by the folding knife 24. The bookbinding stapler 25 is arranged above the press rollers 23 to bind the print media P together by stapling the center of the print media P. In the present embodiment, the stack plate 22 includes an upper stack plate 22*a* and a lower stack plate 22*b*,which are located above and below the folding knife 24.

In addition, the bookbinding device 20 includes a lifting device 26 to change a loading position of print media P on the stack plate 22 according to a size of the print media P. The lifting device 26 includes a lifting member 26*a* movably installed to the lower stack plate 22*b* to support lower ends of the print media P loaded on the lower stack plate 22*b*,a lifting motor 26*b* that is rotatable forward or reverse, a pair of lifting pulleys 26*c* arranged at opposite sides of the lifting member 26*a* in a lifting direction, and a lifting belt 26*d* supported at both sides thereof on the pair of lifting pulleys 26*c*.The lifting member 26*a* is installed to the lower stack plate 22*b* so as to be obliquely movable up and down by an inclination corresponding to that of the lower stack plate 22*b*.The lifting member 26*a* is also connected to the lifting belt 26*d* so as to move up or down according to a rotating direction of the lifting motor 26*b*,thereby vertically changing a loading position of the print media P the lower ends of which are supported thereon.

Accordingly, the print media P transmitted from the image forming apparatus 200 drop under guidance of the guide plate 21 and are loaded on the stack plate 22 in a stacking operation. The guide plate 21 controls the print media P to change a path from the discharging port 200*a* to the stack plate 22. After a preset number of print media P is loaded on the stack plate 22, the bookbinding stapler 25 staples the center of the print media P in a stapling operation. The completely stapled print media P is moved down by the lifting device 26 and thereafter, the folding knife 25 and the pair of press rollers 23 fold the print media P into two on the basis of the center of the print media P in a folding operation and a feeding operation, completing the bookbinding operation of the bookbinding device 20.

Figure 3:
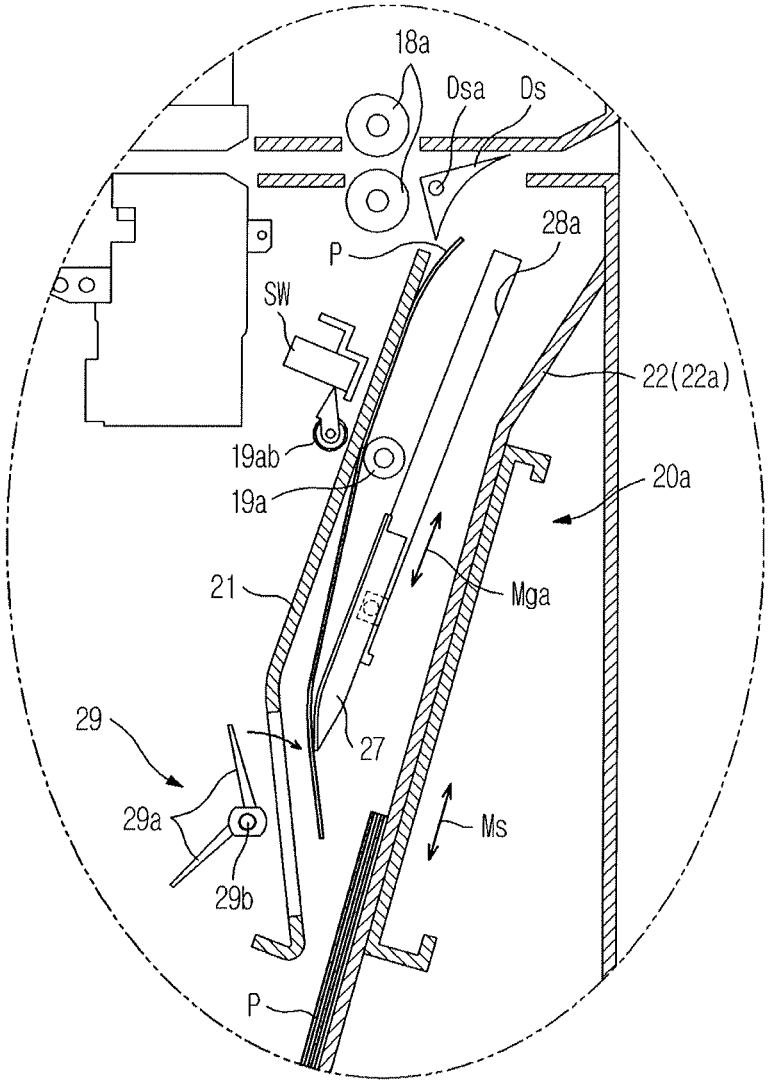
FIGS. 3, 4A, 4B, and 4C are schematic views illustrating the guide member and the operation of the guide member provided in the print-medium post-treatment apparatus according to the exemplary embodiment of the present general inventive concept.

Referring to FIG. 3, a distributing unit Ds is located on a path extended from the discharging port 200*a* to distribute the print media P into the main path 18 and the bookbinding delivery path 19 or the third direction. The distributing unit Ds is disposed to rotate about an axis of a shaft Dsa. The shaft Dsa may be controlled by a controller of the image forming apparatus 200 or a control unit of the print-medium post-treatment apparatus 100 according to one of modes, for example, the bookbinding operation, the punching operation, and the stapling operation. The bookbinding operation may include a stacking operation to receive the print media P and to stack the received print media P, a position adjusting operation to control or adjust a position of the print media with respect to the stapler 25, a stapling operation to staple the stacked print media P, a folding operation to fold the stapled print media P, and/or a feeding operation to feed the folded print media P toward the tray 13.

In addition, the stacking unit 20*a* of the bookbinding device 20 includes a guide member 27 to change a drop position of a leading end of each print medium P from the guide plate 21 with respect to the stack plate 22 according to a size of the print media P to be bound, stacked and/or stapled.

The guide member 27 is downwardly spaced apart from the guide plate 21 and is movable in a direction parallel to the guide plate 21 so as to be located above a partial upper end region of the print media P loaded on the stack plate 22. This configuration can prevent a print medium P, which drops under guidance of the guide plate 21, from erroneously entering between the print media P loaded on the stack plate 22 and consequently, preventing sequence upset of the print media P to be bound, stacked and/or stapled.

To move the guide member 27, the bookbinding device 20 includes a guide motor 27*a* that is rotatable forward or reverse, a pair of guide pulleys 27*b* arranged in a moving direction of the guide member 27 so as to be rotated upon receiving rotational force from the guide motor 27*a*, and a guide belt 27*c* supported at both sides thereof on the guide pulleys 27*b* to transmit rotational force from the guide motor 27*a* to the guide pulleys 27*b*. Either end of the guide member 27 is connected to the guide belt 27*c*, so that the guide member 27 is reciprocally moved in a direction parallel to the guide plate 21 according to forward or reverse rotation of the guide motor 27*a*.

The bookbinding device 20 further includes a pair of supporting plates 28 to support both ends of the guide plate 21 and the stack plate 22. The above described guide motor 27*a* and guide pulleys 27*b* are installed to the supporting plates 28. Each of the supporting plates 28 has a guide slot 28*a* extending parallel to the guide plate 21. As the end of the guide member 27 is movably fitted into the guide slot 28*a*, the guide member 27 is moved under guidance of the guide slot 28*a*.

In addition, the bookbinding device 20 includes paddles 29 rotatably installed to the supporting plates 28, to cause the leading end of the dropping print medium P to come into close contact with the stack plate 22 via rotation of the paddles 29. The paddles 29 are rotatably installed to the supporting plates 28 via a shaft 29*b* both ends of which are rotatably installed to the supporting plates 28. A paddle motor 29*c* is connected to the shaft 29*b* to enable rotation of the paddles 29. Each of the paddles 29 includes a pair of paddle parts 29*a* extending outward in a radial direction thereof, the pair of paddle parts 29*a* being arranged to have an obtuse angle in a circumferential direction. Whenever the paddle 29 rotates once, the paddle 29 pushes the print medium P twice, the leading end of the print medium P can come into close contact with the stack plate 22 or an upper surface of an uppermost one of the print media P loaded or stacked on the stack plate 22.

Hereinafter, operation of the print-medium post-treatment apparatus 100 having the above described configuration will be described in detail with reference to the accompanying drawings.

Figure 4A:
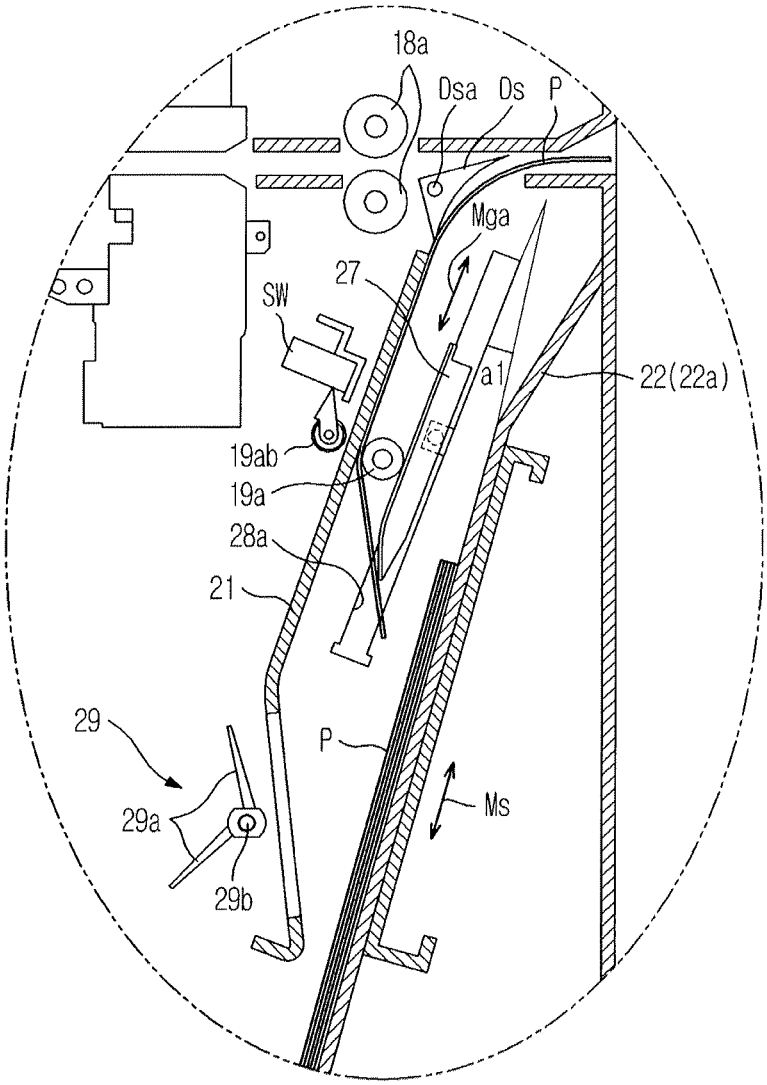
Figure 4B:
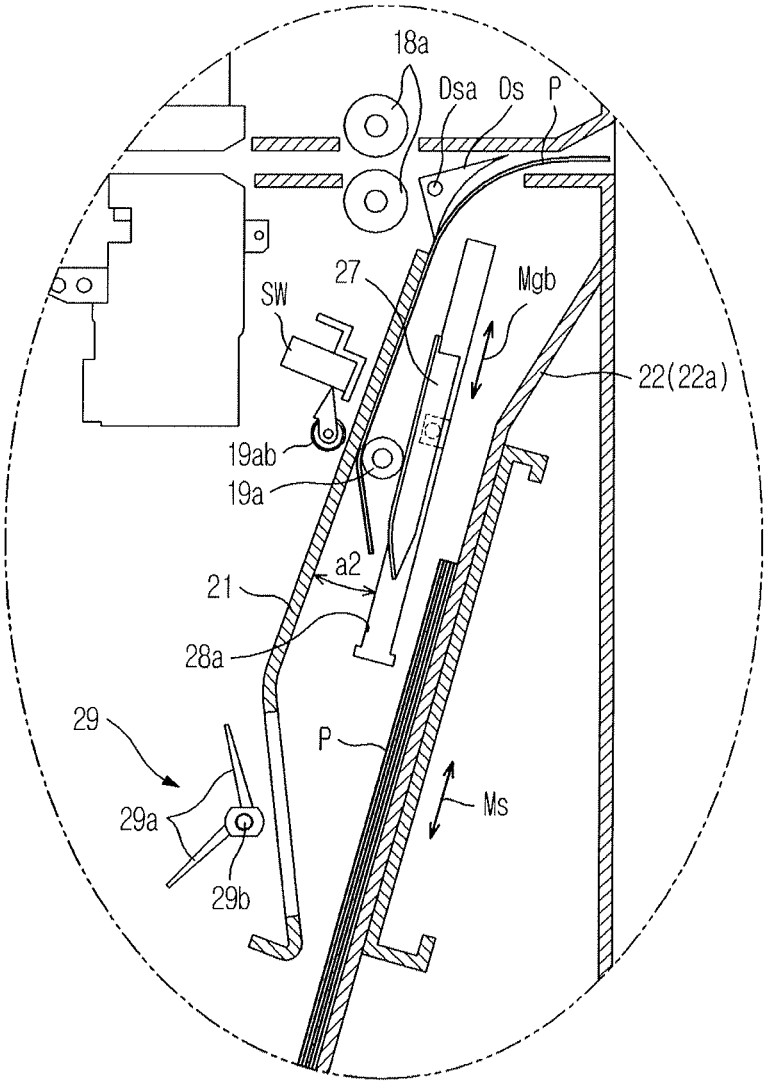
Figure 4C:
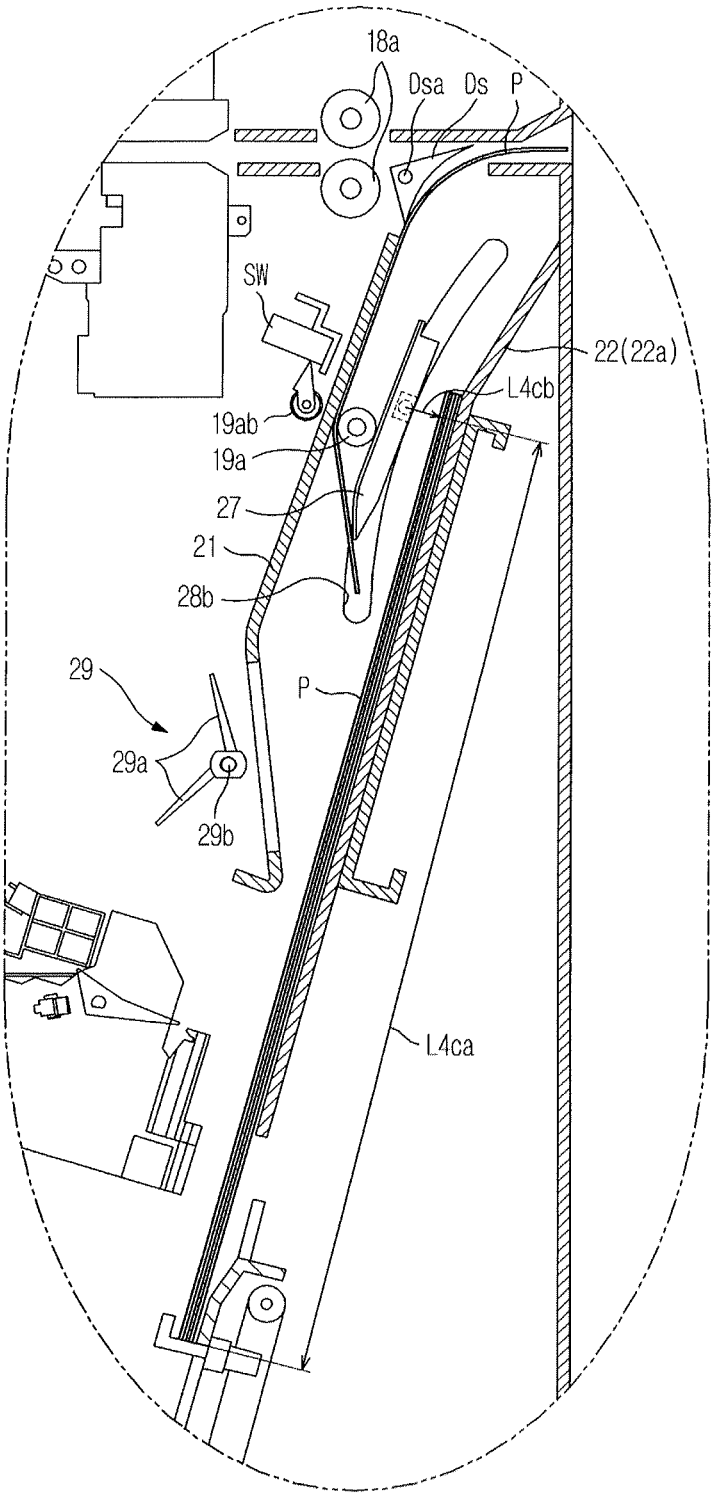

FIG. 3 illustrates a bookbinding device 20 to provide a bookbinding operation of bookbinding small-size print media P, and FIGS. 4A, 4B, and 4C illustrate a bookbinding device 20 to provide a bookbinding operation of bookbinding large-size print media P. An upper end position of the print media P loaded on the stack plate 22 is changed with respect to the stack plate 22 according to a size of the print media P. Accordingly, when the guide member 27 is moved according to a size of the print media P so as to be located immediately above or near the upper end of the print media P, the leading end of each print medium P passing between the guide plate 21 and the guide member 27 drops toward an upper surface of the print media P at a position spaced apart from the upper end of the print media P loaded on the stack plate 22. In addition, the leading end of the dropping print medium P is moved to the stack plate 22 by rotation of the paddles 29, thereby temporarily coming into contact with the upper surface of the stack plate 22 or an upper surface of an uppermost one of the print media P loaded on the stack plate 22. Since the print medium P continuously drops even in the contact state, the leading end of the dropping print medium P is moved on the upper surface of the print media P, allowing the dropping print medium P to be loaded on the stack plate 22. In this way, it may be possible to prevent the leading end of the dropping print medium P from entering between the loaded print media P and consequently, to prevent sequence upset of the print media P.

Referring to FIGS. 3 and 4A, the guide plate 21 guides the print media P fed from the discharging port 200*a* through the distributing unit Ds to be fed toward the stack plate 22 by changing a direction from the discharging direction of the discharging port 200*a* through the distributing unit Ds. The guide member 27 of the stacking unit 20*a* may move in a direction Mga to control the print media P to be placed in the stack plate 22 in order. The direction Mga of the guide member 27 may not be parallel to a direction (major surface) Ms of the stack plate 22 on which the print media P are stacked. The moving direction Mga of the guide member 27 may have an angle al with the direction Ms of the stack plate 22. The stacking unit 20*a* may include rollers 19*a* and/or 19*ab* to rotate according to a control signal of the controller of the image forming apparatus 200 or a control unit of the post-treatment apparatus 100 such that the print medium P can be received and transferred from the distributing unit Ds toward the stack plate 22. The stacking unit 20*a* may further include a switch SW to be on or off according to a rotation of the roller 19*a* or 19*ab* when the print medium P is fed therethrough.

It is possible that the guide member 27 may be movable with respect to the stack plate 22 according to a size of the print media P. The guide member 27 may be stationary with respect to the stack plate 22 during feeding of a group of print media to be bound or stapled. That is, after the guide member 27 is controlled or moved to be disposed at a position with respect to the stack plate 22 to guide a group of the print media P, the guide member 27 is controlled not to move but to be stationary with respect to the stack plate 22. The group of print media P may be same size, area, length, or width. However, it is also possible that the guide member 27 may be movable with respect to the stack plate 22 according to the number of the print media P or a thickness of the print media P stacked in the stack plate 22. When the print media P are stacked on the stack plate 22, the thickness of the stacked print media P increases, and then the guide member 27 is controlled to be move in the direction Mga to control the leading end of the print media P is placed on an uppermost one of the stacked print media P.

Referring to FIG. 4B, the guide plate 27 may be disposed in a direction Mgb to be parallel to the direction Ms of the stack plate 22. In this case, the moving direction Mgb of the guide plate 27 may have an angle a2 with a surface of the guide plate 21. Accordingly, the guide slot 28*a* may be disposed parallel to the direction Mgb to guide the guide plate 27.

The guide plate 27 may have a width corresponding to a width of the print media P perpendicular to a feeding direction or path or direction Mga or Mgb. The width of the guide plate 27 may be narrower than the width of the print media P. The guide plate 27 may also have a length in the direction Mga or Mgb. The length of the guide plate 27 may be longer than a length of the guide slot 28*a*.It is possible that the length of the guide plate 27 may be at least a difference between the largest one and the smallest one of the print media P which can be placed on the stack plate 22 such that a distal end or an end portion of the guide member 27 can control the leading end of the print media to be fed or stacked on the stack plate 22 in order.

Referring to FIG. 4C, the stacking unit 20*a* may include a guide slot 28*b* which is a non-linear slot or groove which is not parallel to at least one of the guide plate 21 and the stack plate 22. The stacking unit 20*a* may include a guide member 27 to move along the guide slot 28*b* to guide the print media P toward the stack plate 22 or an upper most one of the print media P stacked on the stack plate 22. The guide member 27 may have a distance L4*ca* with a reference R, which may be the lifting member 26*a*, and a distance L4*cb* with a major surface of the stack plate 22. Since the guide slot 28*b* is not linear (or straight) but non-linear (or curved), the distances L4*ca* and L4*cb* may vary according to the size of the print media P or the thickness of the print media P stacked on the stack plate 22.

Figure 5A:
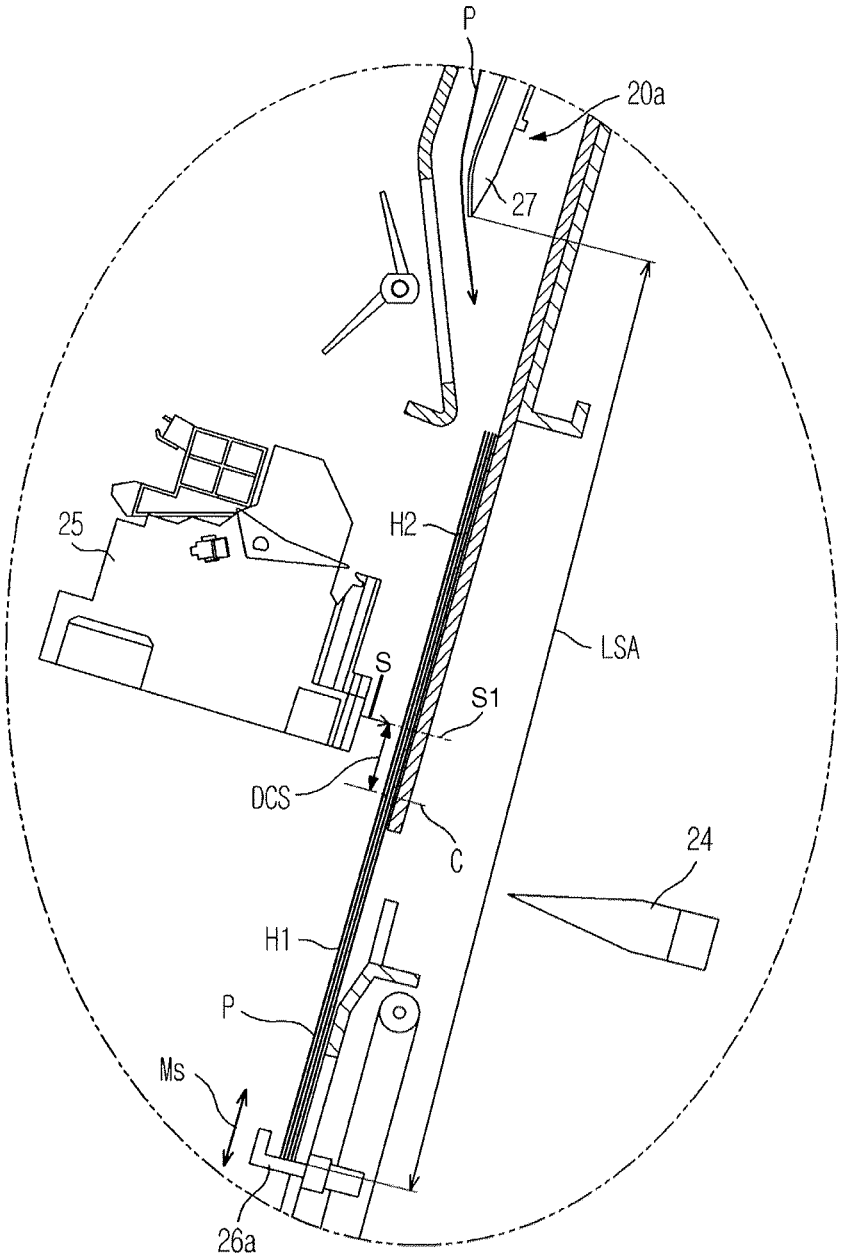
FIGS. 5A, 5B, and 5C illustrate a bookbinding device to perform a stacking operation and a stapling operation according to an embodiment of the present general inventive concept.
Figure 5B:
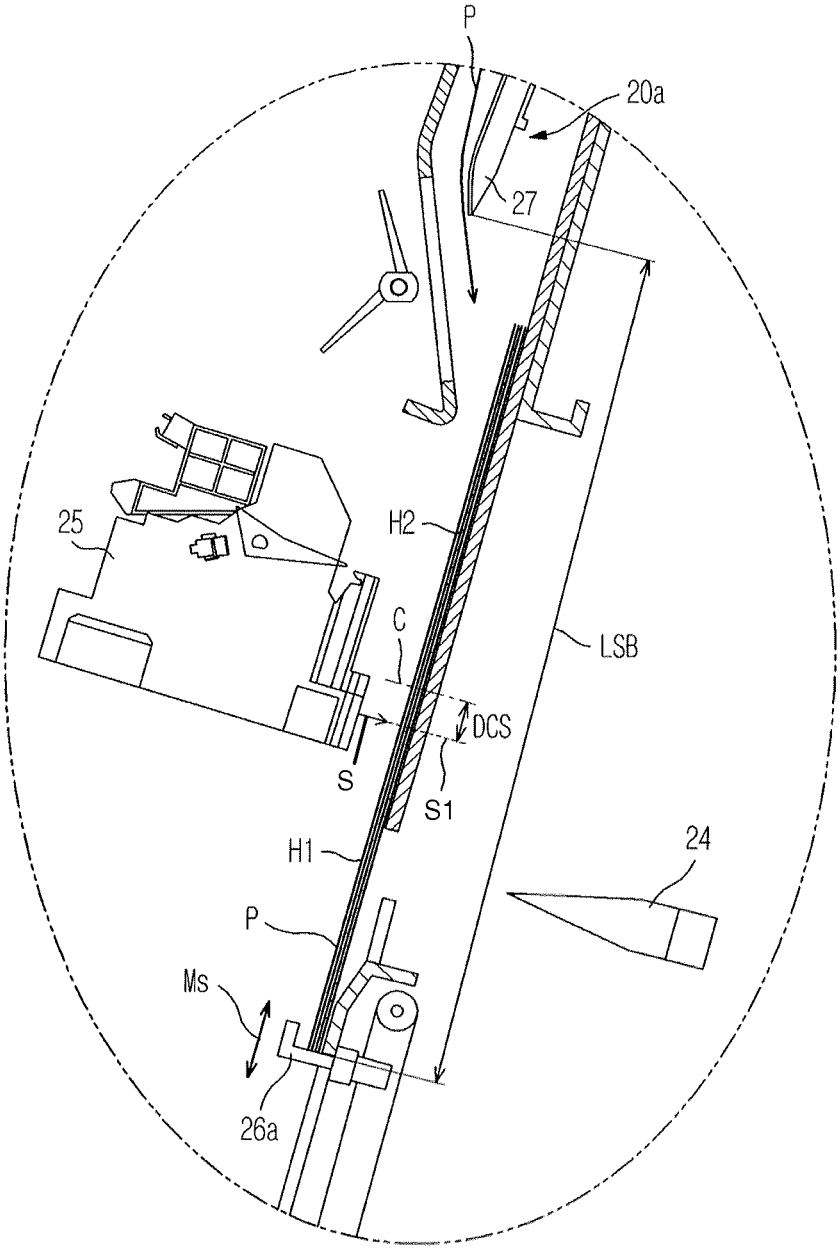
Figure 5C:
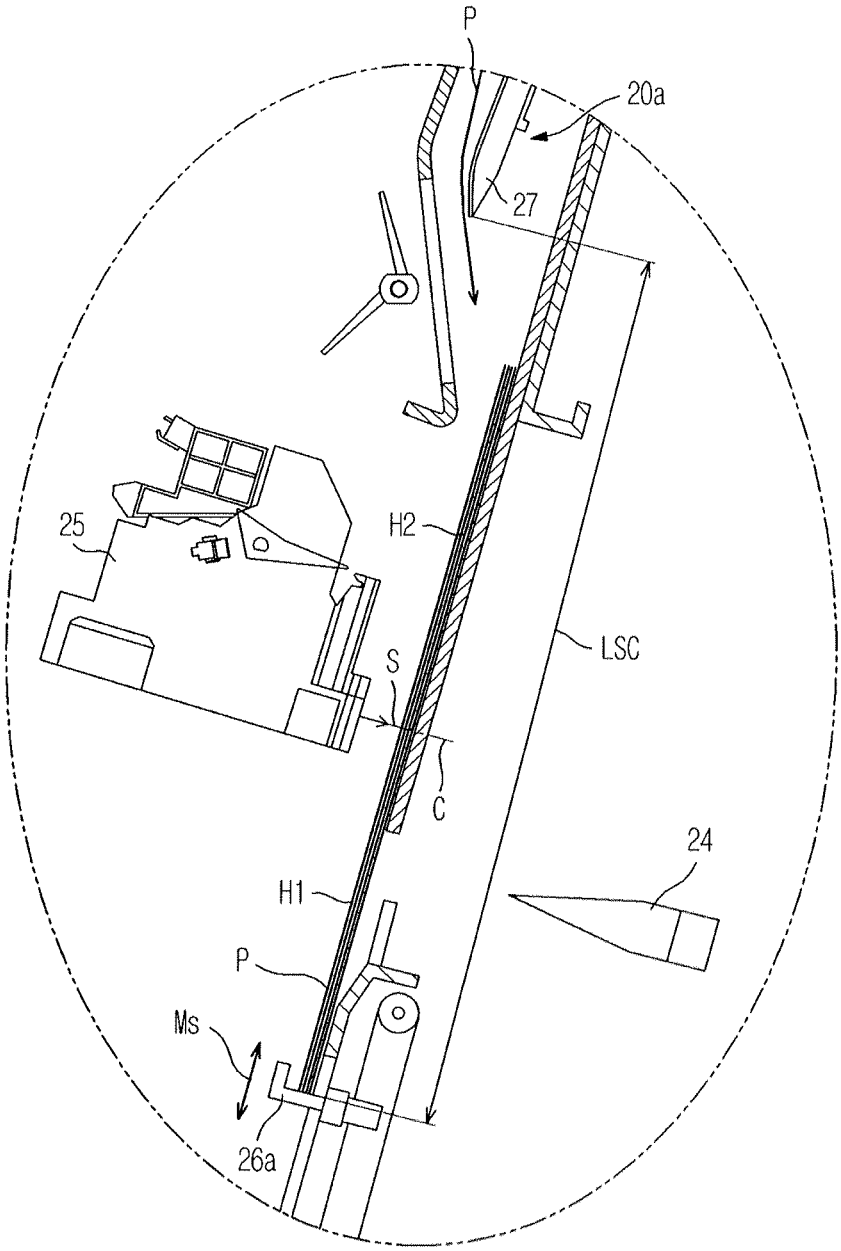

Referring to FIGS. 5A, 5B, and 5C, the guide member 27 includes a distal end disposed to have a distance LSA, LSB, or LSC with an end of the lifting member 26*a* which supports the leading ends of the print media P stacked on the stack plate 22 according to a size of the print media P or the number of the print media P stacked or to be stacked on the stack plate 22. The print media P has a center portion (or a stapling position) C and two portions H1 and H2 disposed opposite to each other with respect to the center portion C. Accordingly, a distance between the distal end of the guide member 27 and the center portion C of the print media P may vary according to a size of the print media P or the number of the print media P stacked or to be stacked on the stack plate 22. Although the print media P has the center portion C, the center portion C may not be a center of the print media P, but a portion of the print media P which is not a center line of the print media P. The bookbinding stapler 25 may have a portion S1 to eject the staple toward the center portion C of the print media P in a direction S for bookbinding or stapling. The portion S1 of the bookbinding stapler 25 may have a distance DCS with the center portion C of the print media P. Accordingly, a distance between the portion S1 of the bookbinding stapler 25 and the distal end of the guide member 27 may be variable according to a size of the print media P or the number of the print media P stacked or to be stacked on the stack plate 22.

As illustrated in FIGS. 5A and 5B, when the center portion C of the print media P is not disposed on the portion S1 of the bookbinding stapler 25, the lifting member 26*a* is controlled by controlling the lifting motor 26*c* according to a control signal generated from a controller of the image forming apparatus 200 or a control unit of the post-treatment apparatus 100 to move in a direction Ms. Accordingly, the center portion C of the print media P is disposed on the portion S1 of the bookbinding stapler 25 as illustrated in FIG. 5C such that the center portion C of the print media P is stapled to bind the print media P.

Figure 6A:
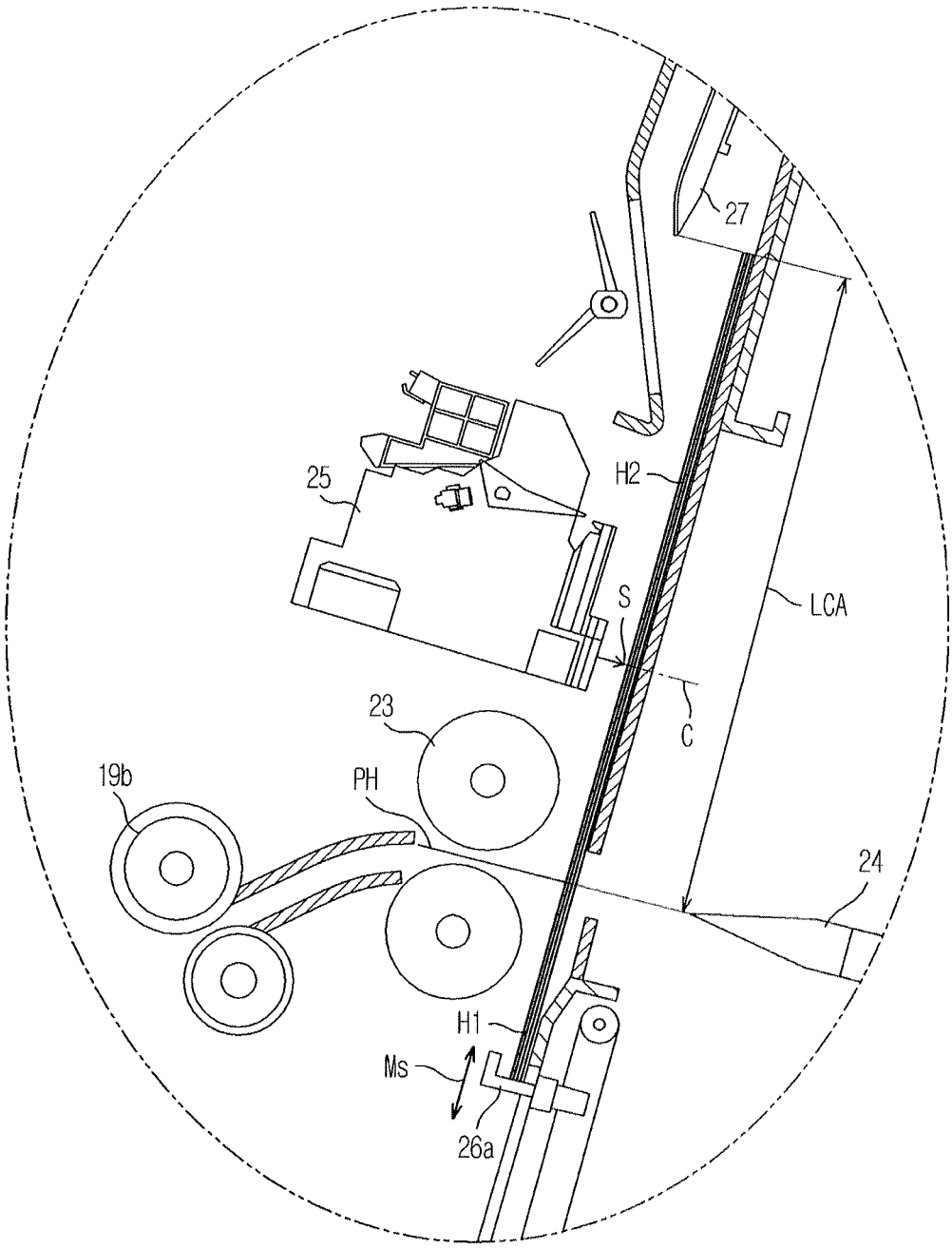
FIGS. 6A, 6B, 6C, 6D and 6E illustrate a bookbinding device to perform a folding and feeding operation according to an embodiment of the present general inventive concept.
Figure 6B:
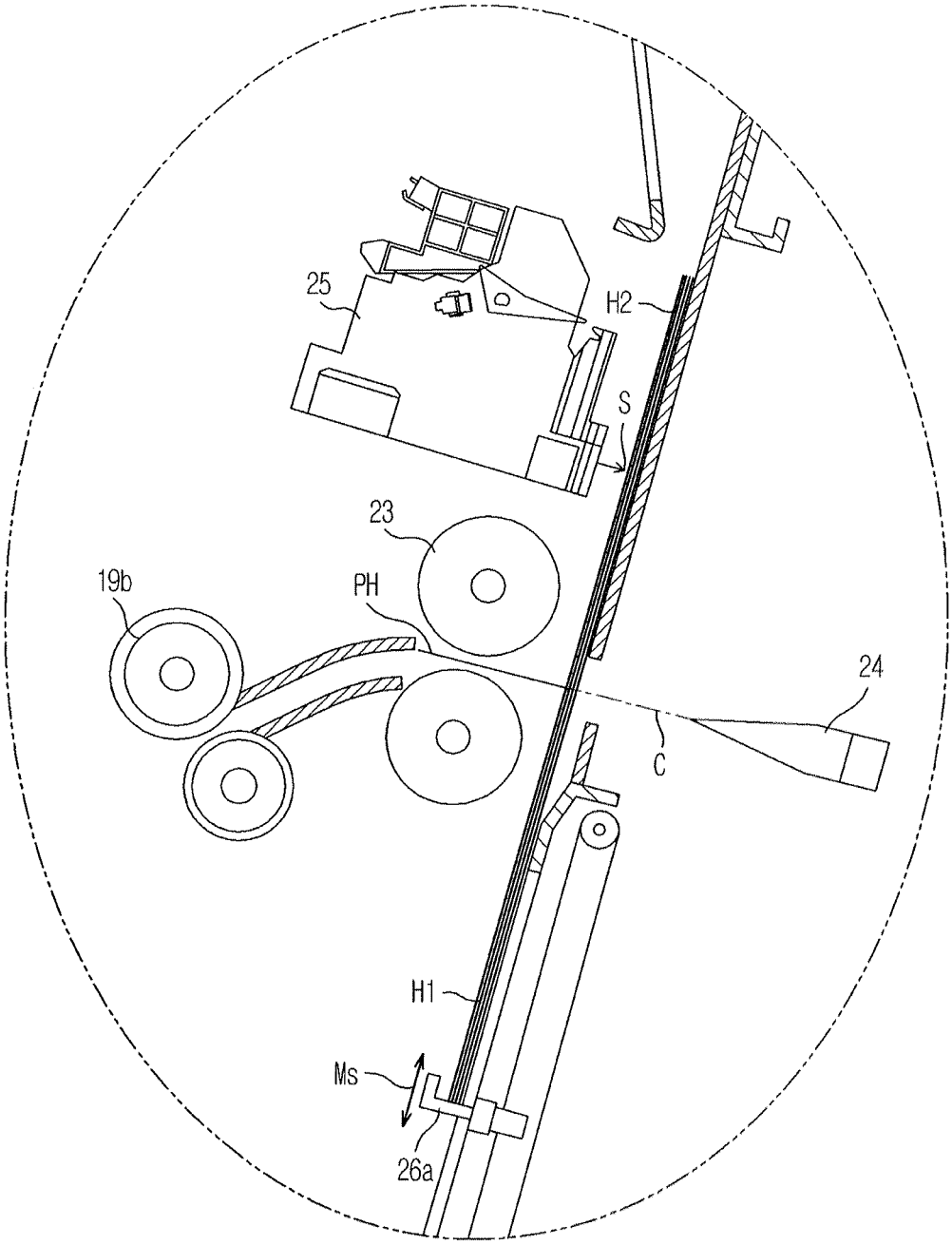
Figure 6C:
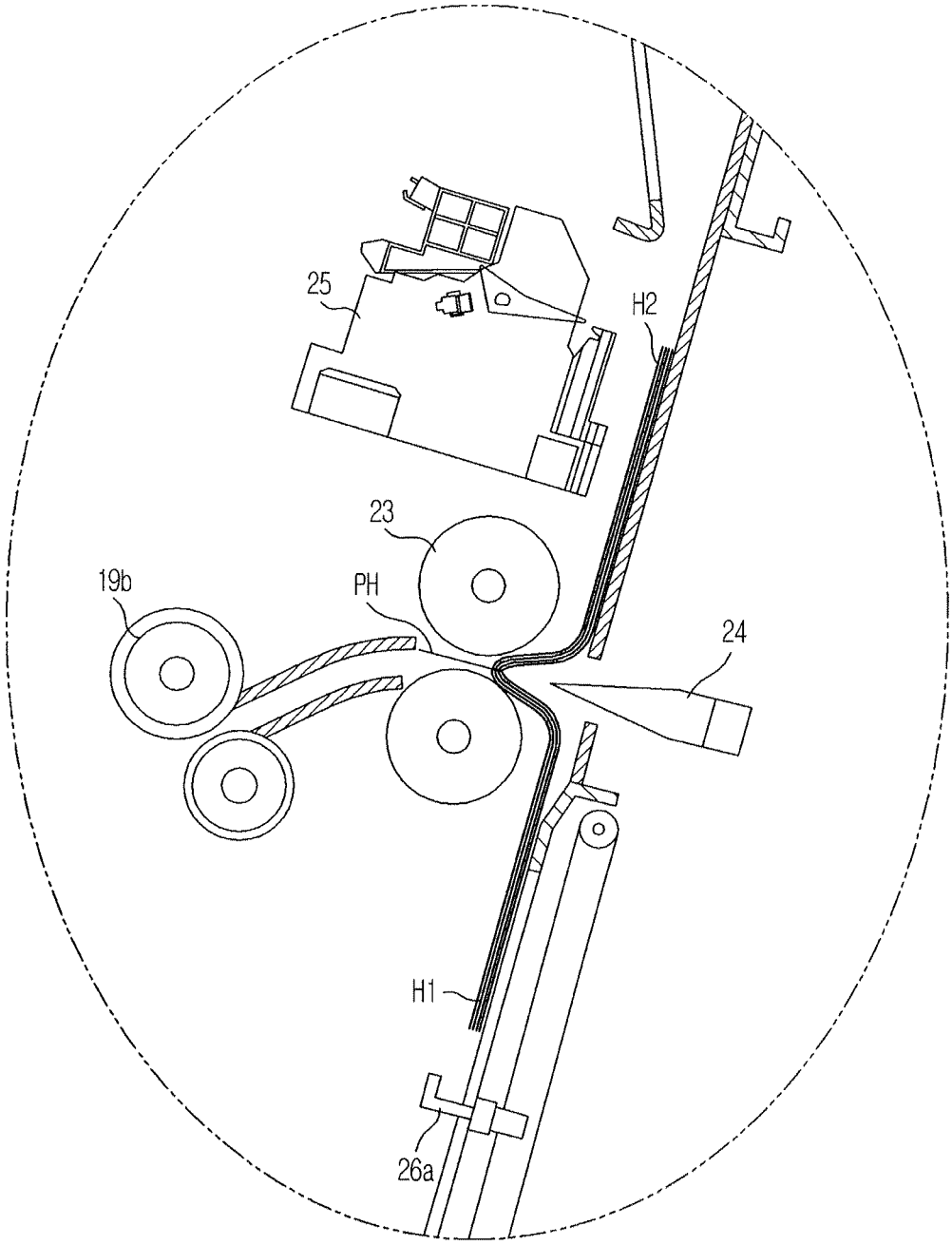
Figure 6D:
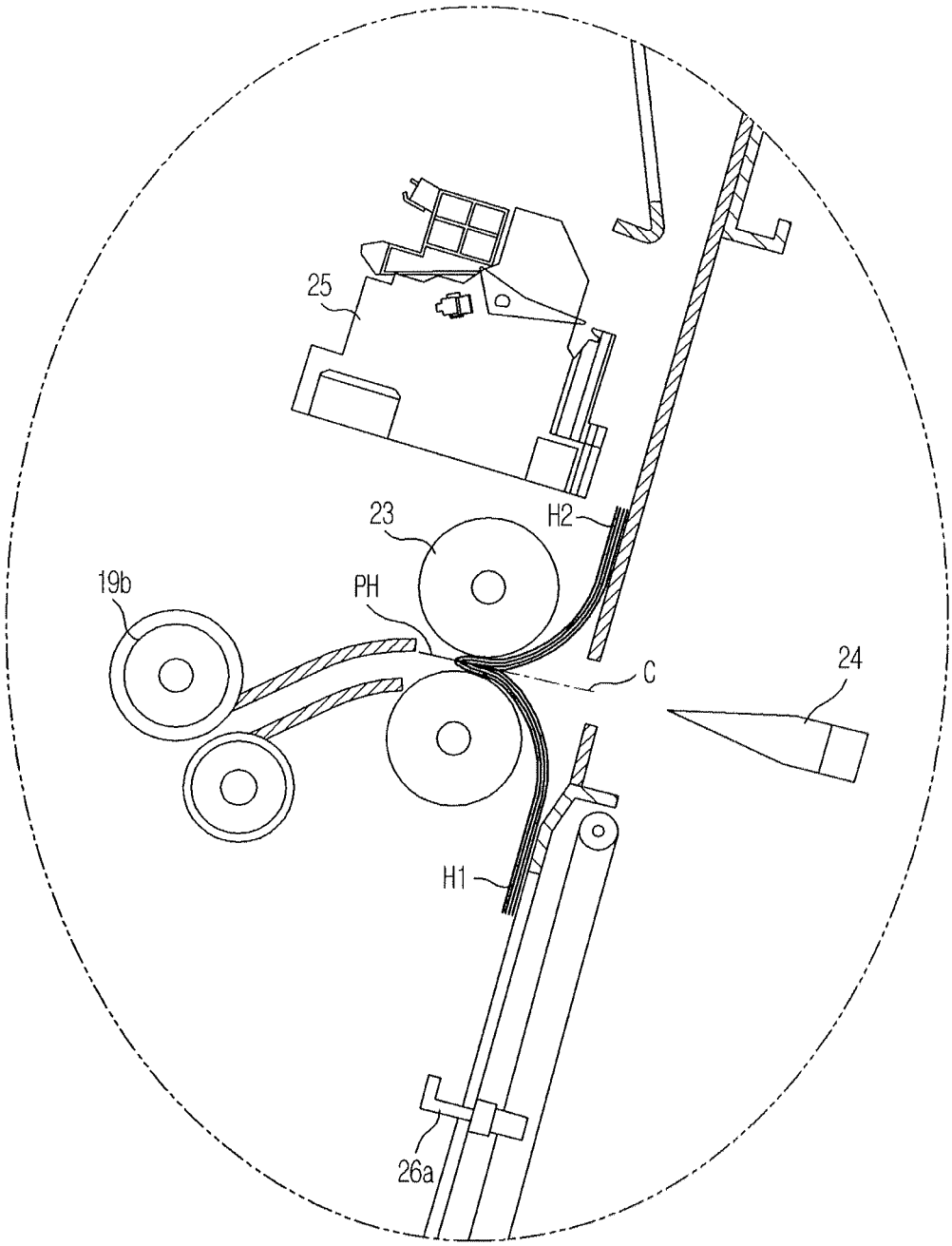
Figure 6E:
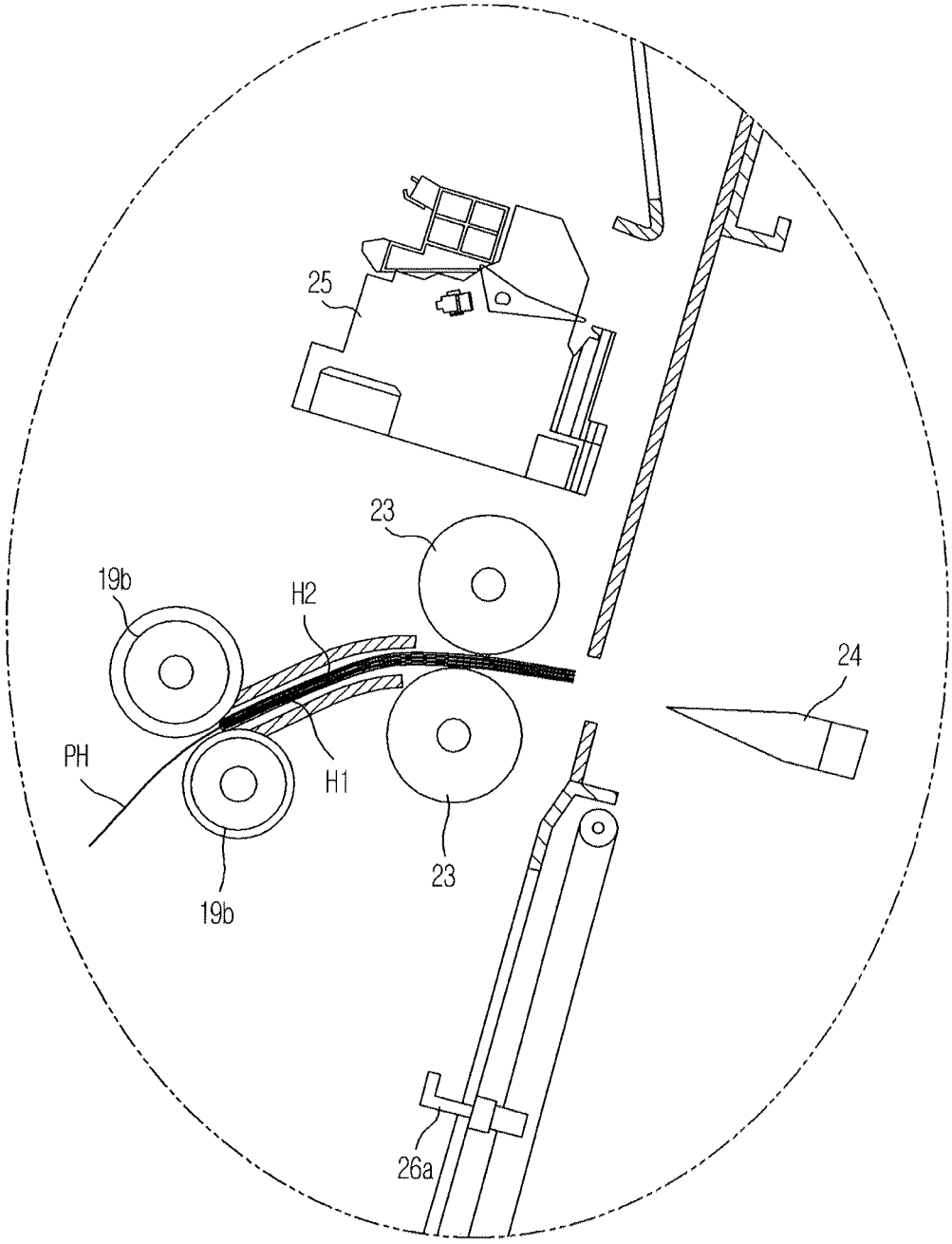

Referring to FIGS. 6A, 6B, 6C, 6D, and 6E, the guide member 27 is spaced apart from a path PH corresponding to the third delivery path 19 by a distance LCA. When the center portion C of the print media P is disposed on the direction S as illustrated in FIG. 6A, one or more staples are ejected from the portion of the bookbinding stapler 25 toward the center portion C of the print media P. It is possible that a mechanical unit can be included to move the bookbinding stapler 25 in the direction S to be disposed at a position close to the print media P to eject the one or more staples to staple the print media P. The lifting member 26*a* is controlled to dispose the center portion C of the print media P to correspond to the path PH as illustrated in FIG. 6B, and then the knife 24 is controlled by a controller of the image forming apparatus 200 or a control unit of the post-treatment apparatus 100 to move in the direction corresponding to the path PH such that the center portion C of the print media P is pushed into a space along the path PH between the rollers 23 as illustrated in FIG. 6C. The portions H1 and H2 of the print media P are folded with respect to the center portion C of the print media or the path PH. As illustrated in FIGS. 6D and 6E, the folded print media P may be further pushed or fed by the rollers 23 and/or the rollers 19*b* along the path PH corresponding to the third delivery path 19. The rollers 23 (19*b*) may be formed with a pair of rollers which are movable with respect to each other to accommodate the folded print media P. It is possible that one of the rollers 23 is movable with respect to the other one of the rollers 23. The rollers 23 (19*b*) may be controlled to rotate to receive and feed the folded print media P as a book along the path PH or the third delivery path 19.

When the stapled print media P is needed to be fed along the path PH without a folding operation, the lifting member 26*a* is controlled to move to a position where the leading ends of the stacked and stapled print media P correspond to the path PH, and the knife 24 is controlled to move in the direction and guide the leading ends of the print media P toward the space between the rollers 23.

Figure 7A:
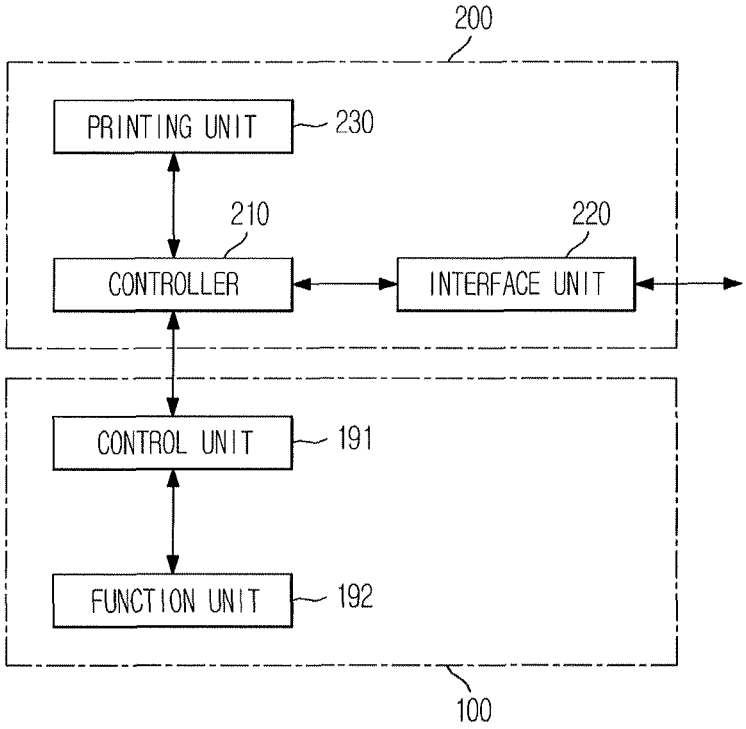
FIGS. 7A and 7B illustrate an image forming apparatus with a bookbinding device according to an embodiment of the present general inventive concept.

Referring to FIG. 7A, the image forming apparatus 200 includes a printing unit 230 to form or print an image on each of the print media P and to discharge the printed print media P through the discharging port 200*a*,an interface unit 220 to communicate with a user or an external device to receive data corresponding to the image to be printed and/or one or more commands to perform the printing operation, and a controller to control the respective units of the image forming apparatus 200 and/or units of the post-treatment apparatus 100 to perform operations, for example, the delivery operation, stapling operation, punching operation, and bookbinding operation as described above. The post-treatment apparatus 100 includes a control unit 191 to receive a control signal from the controller 210 to control corresponding units of the post-treatment apparatus 100 or to transmit the receive control signal to the corresponding units of the post-treatment apparatus 100 to perform the operations, for example, the delivery operation, stapling operation, punching operation, and bookbinding operation as described above. The post treatment apparatus 100 further includes a function unit 192 to controls the respective units, for example, the punch 14, the stapler 15, the bookbinding stapler 25, rollers, motors, guide member 27, folding knife 24, etc., to perform the corresponding operations.

Figure 7B:
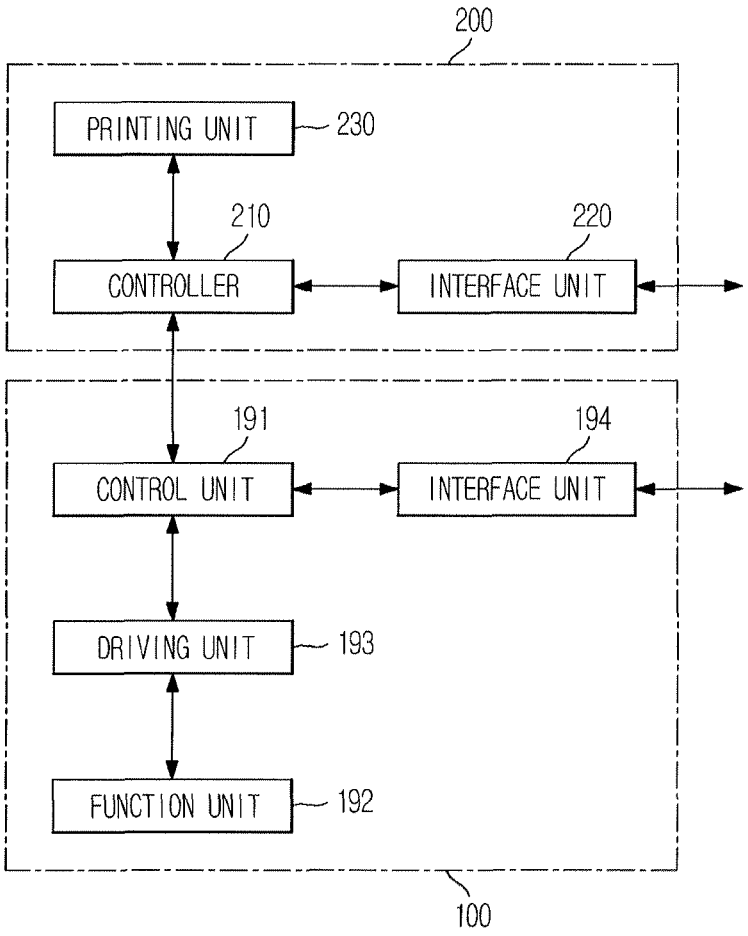

Referring to FIG. 7B, the image forming apparatus 200 includes a printing unit 230 to form or print an image on each of the print media P and to discharge the printed print media P through the discharging port 200*a*, an interface unit 220 to communicate with a user or an external device to receive data corresponding to the image to be printed and/or one or more commands to perform the printing operation, and a controller to control the respective units of the image forming apparatus 200 and/or units of the post-treatment apparatus 100 to perform operations, for example, the delivery operation, stapling operation, punching operation, and bookbinding operation as described above. The post-treatment apparatus 100 includes a control unit 191 to receive a control signal from the controller 210 to control corresponding units of the post-treatment apparatus 100 or to transmit the receive control signal to the corresponding units of the post-treatment apparatus 100 to perform the operations, for example, the delivery operation, stapling operation, punching operation, and bookbinding operation as described above. The post treatment apparatus 100 further includes a driving unit 193 to receive the control signal from the control unit 191 to control the respective elements or units of the function unit 192 to controls the respective operations and structures as described above. The post treatment apparatus 100 may further include an interface unit 194 to receive data or command from an external device or a user to control the control unit to perform the above-described operations.

As apparent from the above description, according to the exemplary embodiment of the present general inventive concept, it may be possible to change a drop position of a leading end of a dropping print medium according to a size of the print medium. This has the effect of preventing the dropping print medium from entering between previously loaded print media, thereby preventing sequence upset (disruption of sequential order) of the print media. Accordingly, the print media are placed on the stack plate in order or according to a page number or a predetermined order of the pages arranged according to an input signal of the interface unit or the control unit of the apparatus to perform the above-describe operations.

Although a few embodiments of the present general inventive concept have been shown and described, it would be appreciated by those skilled in the art that changes may be made in these embodiments without departing from the principles and spirit of the general inventive concept, the scope of which is defined in the claims and their equivalents.

What is claimed is:

1. A bookbinding device usable with an image forming apparatus, comprising:

a stack plate disposed to receive a print medium along a stacking direction;

a guide plate disposed to receive the print medium and to guide the received print medium toward the stack plate; and a guide member disposed in a space formed between the stack plate and the guide plate to move within the space and configured to be driven by a guide motor, wherein the guide member is disposed at vertically different positions depending on a size of the print medium stacked on the stack plate, and configured to guide the print medium toward the stack plate by making contact with the print medium falling from the guide plate at each of the vertically different positions.

2. The bookbinding device of claim 1, wherein the guide member moves between a first position and a second position to control a dropping position of the leading end of the print medium with respect to the stack plate.

3. The bookbinding device of claim 1, wherein the guide plate has a surface to contact the print medium to guide the leading end of the print medium to free-fall toward the stack plate from the guide plate.

4. The bookbinding device of claim 3, wherein the guide member contacts the free-falling leading end of the print medium to change a dropping direction of the leading end of the print medium with respect to the stack plate.

5. The bookbinding device of claim 1, wherein the guide member controls the free-falling leading end of the print medium to be stacked on the stack plate.

6. The bookbinding device of claim 1, wherein:

the print medium comprises a first print medium and a second print medium, the guide member moves with respect to at least one of the guide plate and the stack plate to control the free-falling end of the print medium such that the second print medium is prevented from being inserted between the stack plate and the first print medium which has been stacked on the stack plate.

7. The bookbinding device of claim 6, wherein the guide member is movable with respect to the stack plate before the first print medium and the second print medium are guided and stacked, and the guide member is stationary during stacking the first print medium and the second print medium.

8. The bookbinding device of claim 6, wherein the guide member is movable with respect to the stack plate when the first print medium and the second print medium are guided and stacked on the stack plate.

9. The bookbinding device of claim 1, wherein the guide member moves in a direction to change a drop position of the leading end of the print medium with respect to the stack plate.

10. The bookbinding device of claim 1, further comprising:

a frame to accommodate the stack plate and the guide member, wherein the frame comprises a guide slot formed thereon to guide the guide member to be movable in a direction to correspond to the stacking direction.

11. The bookbinding device of claim 10, wherein the guide slot is formed in a linear-guide slot to linearly guide the guide member.

12. The bookbinding device of claim 10, wherein the guide slot is formed in a non-linear-guide slot to non-linearly guide the guide member.

13. The bookbinding device of claim 1, wherein the guide member moves in a direction having an angle with a major surface direction of the stack plate on which the print medium is fell and stacked.

14. The bookbinding device of claim 1, further comprising:

a bookbinding stapler disposed to staple the print medium stacked on the stack plate, wherein the guide member moves with respect to the bookbinding stapler.

15. The bookbinding device of claim 14, wherein the stack plate moves with respect to the bookbinding stapler to adjust a position of the stack print medium according to a stapling position of the stacked print medium.

16. The bookbinding device of claim 14, further comprising:

a folding element disposed to be movable to fold the stapled print medium, wherein the guide member is movable with respect to the folding element when the folding element is stationary.

* * * * *